US010297941B2

(12) United States Patent
Huang et al.

(10) Patent No.: US 10,297,941 B2
(45) Date of Patent: May 21, 2019

(54) SOCKET CONNECTOR AND SOCKET TERMINAL THEREOF

(71) Applicant: CviLux Corporation, New Taipei (TW)

(72) Inventors: Wen-Hsin Huang, New Taipei (TW); Chin-Chiang Chen, Taipei (TW)

(73) Assignee: CVILUX CORPORATION, New Taipei (TW)

( * ) Notice: Subject to any disclaimer, the term of this patent is extended or adjusted under 35 U.S.C. 154(b) by 0 days.

(21) Appl. No.: 16/007,988

(22) Filed: Jun. 13, 2018

(65) Prior Publication Data

US 2019/0097344 A1 Mar. 28, 2019

(30) Foreign Application Priority Data

Sep. 26, 2017 (TW) ..... 106132925 A

(51) Int. Cl.

| | |
|---|---|
| ***H01R 13/187*** | (2006.01) |
| ***H01R 13/11*** | (2006.01) |
| ***H01R 4/18*** | (2006.01) |
| ***H01R 13/432*** | (2006.01) |

(52) U.S. Cl.

CPC ..... *H01R 13/114* (2013.01); *H01R 4/184* (2013.01); *H01R 13/432* (2013.01); *H01R 13/187* (2013.01)

(58) Field of Classification Search

CPC ..... H01R 13/114; H01R 13/187

See application file for complete search history.

(56) References Cited

U.S. PATENT DOCUMENTS

| | | | | |
|---|---|---|---|---|
| 5,356,318 A * | 10/1994 | Fry | ..... | H01R 4/185 439/877 |
| 6,186,840 B1 * | 2/2001 | Geltsch | ..... | H01R 13/18 439/748 |
| 6,394,858 B1 * | 5/2002 | Geltsch | ..... | H01R 13/114 439/843 |
| 7,048,597 B2 * | 5/2006 | Chen | ..... | H01R 13/113 439/851 |

* cited by examiner

*Primary Examiner* — Tho D Ta

(74) *Attorney, Agent, or Firm* — Li & Cai International Property (USA) Office

(57) ABSTRACT

A socket connector includes an insulated housing and at least one socket terminal. The insulated housing has at least one terminal passage for receiving the at least one socket terminal. The socket terminal has a fixing portion, a conductive clasp extending rearward from the fixing portion along a longitudinal direction, and a pair of contacting arms respectively extending from two opposite sides of the fixing portion. Each contacting arm has an elastic clasp extending from the fixing portion along the longitudinal direction, a port portion connecting to a front end of the elastic clasp, and at least one extending portion extending rearward from an inner side of the port portion. A part of the elastic clasp is bent inward to form a second contacting portion. A part of the port portion and the extending portion form a first contacting section.

12 Claims, 6 Drawing Sheets

SOCKET CONNECTOR AND SOCKET TERMINAL THEREOF

BACKGROUND OF THE INVENTION

1. Field of the Invention

The present disclosure is related to a socket connector and a socket terminal thereof, in particular, to an electric connector for transmitting electric power, and socket terminals or female terminals for electric conduction.

2. Description of Related Art

Electric connectors have been widely applied to transmit signals or electric power. The electric connector used to transmit electric power is also called a power connector. Power connectors can be divided into plugging ends and socket ends, which are called plug connectors and socket connectors.

The plug connector has a plurality of plug terminals, which are usually shaped as pins. The socket connector has a plurality of socket terminals which are made of metal boards by punching and bending processes. More and more electronic devices need to plug the plug connector into the socket connector in the power-on state. During plug-in or pull-off processes in power-on state, an electric arc may be generated by the electric current crossing from one terminal to another terminal through the air. The electric arc may damage the terminals or produce residues thereon, which will affect the performance of electric conduction.

SUMMARY OF THE INVENTION

One of the objectives of the present disclosure is to provide a socket connector and a socket terminal thereof, which is able to reduce the problems of damaging terminals of the socket terminal due to electric arc discharge, so as to prolong the useful life of the socket terminal.

In order to achieve the above objectives, according to one exemplary embodiment of the present disclosure, a socket connector is provided and includes an insulated housing and at least one socket terminal. The insulated housing is formed with at least one terminal passage. The at least one socket terminal is received in the at least one terminal passage. The socket terminal has a fixing portion, a conductive clasp, and a pair of contacting arms. The conductive clasp extends rearward from the fixing portion along a longitudinal direction. The pair of contacting arms extend forward from two opposite sides of the fixing portion, respectively, and face each other. Each of the contacting arms includes an elastic clasp, a port portion, and at least one extending portion. The elastic clasp extends forward from the fixing portion along the longitudinal direction. The port portion connects to a front end of the elastic clasp. The at least one extending portion extends rearward from an inner side of the port portion. A part of the elastic clasp is curved inward to form a second contacting portion. A part of the port portion and the extending portion are configured to form a first contacting section.

In order to achieve the above objectives, according to one exemplary embodiment of the present disclosure, a socket terminal is provided and includes a fixing portion, a conductive clasp and a pair of contacting arms. The conductive clasp is extends rearward from the fixing portion along a longitudinal direction. The pair of contacting arms extend forward from two opposite sides of the fixing portion, respectively, and face each other. Each of the contacting arms includes an elastic clasp, a port portion, and at least one extending portion. The elastic clasp extends forward from the fixing portion along the longitudinal direction. The port portion connects to a front end of the elastic clasp. The at least one extending portion extends rearward from an inner side of the port portion. A part of the elastic clasp is curved inward to form a second contacting portion. A part of the port portion and the extending portion are configured to form a first contacting section.

Thus, the present disclosure has the advantages as follows. According to the present disclosure, if an electric arc is generated when the plug terminal is plugging in or pulling out of the socket terminal, to the electric arc only strikes the extending portion. Therefore, the second contacting portion of the elastic clasp can be prevented from being damaged by the electric arc, and can avoid residual carbon deposit from the electric arc.

For further understanding of the present disclosure, reference is made to the following detailed description illustrating the embodiments and examples of the present disclosure. The description is for illustrative purpose only and is not intended to limit the scope of the claim.

DETAILED DESCRIPTION OF THE EXEMPLARY EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

Figure 1:
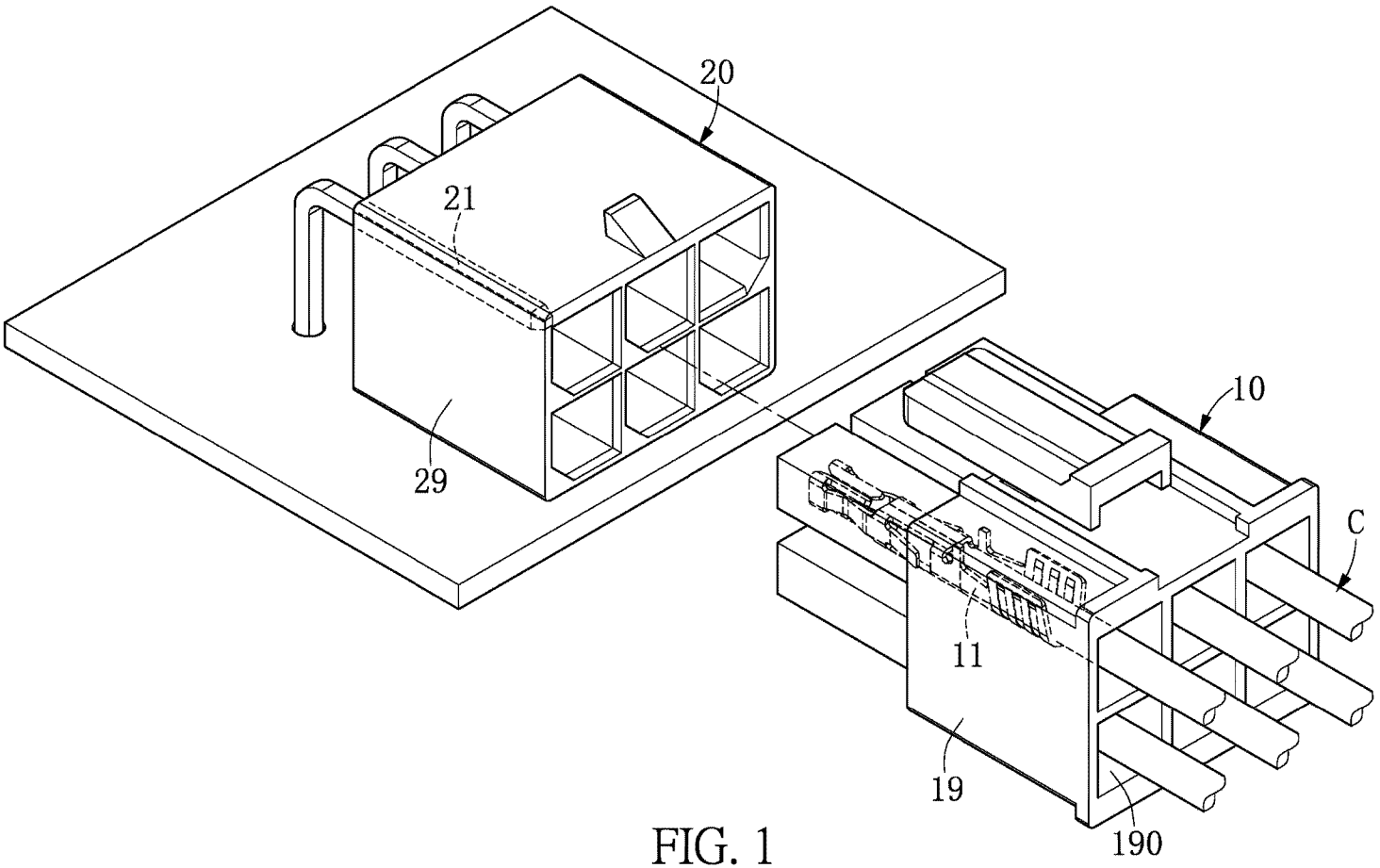
FIG. 1 is a perspective view of a socket connector with high-density contacts of the present disclosure.
Figure 2:
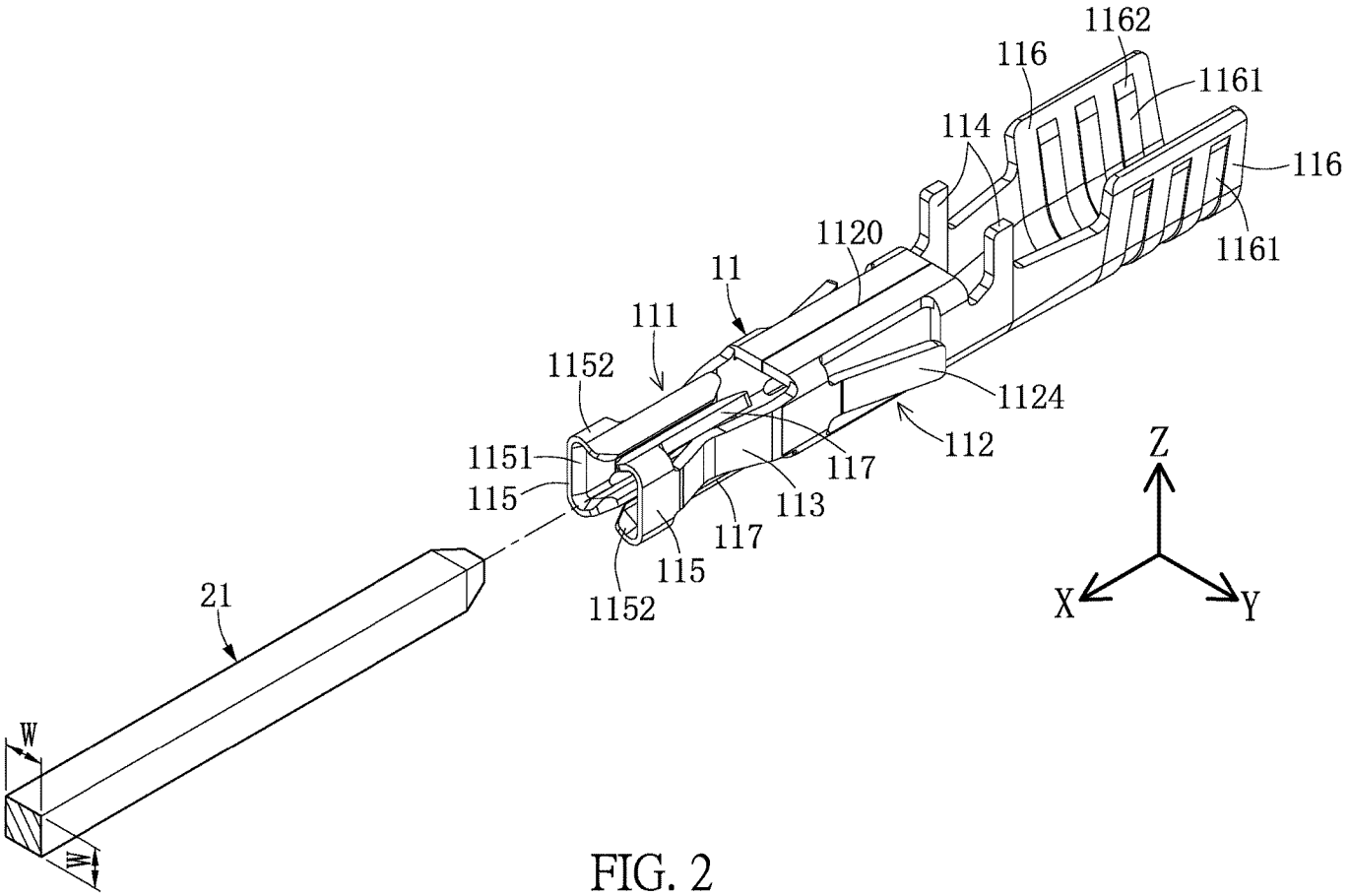
FIG. 2 is a perspective view of a terminal set of the present disclosure.

Reference is made to FIG. 1 and FIG. 2, which are a perspective view of a socket connector and a perspective view of a terminal set of the present disclosure. The present disclosure provides a socket connector 10, which is capable of mating with a plug connector 20. The socket connector 10 includes an insulated housing 19 and a plurality of socket terminals 11. The insulated housing 19 is formed with a plurality of terminal passages 190. The number of the terminal passages 190 corresponds with the number of the socket terminals 11, which can be at least one. The socket terminals 11 have rear ends respectively connected to a wire C. The plug connector 20 has a plug housing 29 and a plurality of plug terminals 21. The plug terminals 21 are inserted toward a front end of the socket terminals 11. Each plug terminal 21 is shaped as a square pin, and has four side lengths W that are substantially identical with each other. However, the present disclosure is not limited thereto.

The socket terminals 11 are received in the terminal passages 190 correspondingly. Each socket terminal 11 has a fixing portion 112, a conductive clasp 116, and a pair of contacting arms 111. The conductive clasp 116 extends rearward from the fixing portion 112 along a longitudinal direction. The pair of contacting arms 111 extend forward from two opposite sides of the fixing portion 112, respectively, and face each other. The directions of forward and rearward in this embodiment are only for convenience of description and are not limited by the present disclosure. The longitudinal direction refers to a direction that is parallel to a direction defined by a front end to a rear end of the socket terminal 11, and is similar to the direction of the X axle in FIG. 2.

The fixing portion 112 is substantially shaped as a hollow cylinder along the longitudinal direction and is formed with a linking seam 1120. In addition, the fixing portion 112 also includes a pair of fixing wings 1124 spread outward from two sides thereof in an opposite manner, which is helpful for fixing the socket terminal 11 in the terminal passage 190. In this embodiment, the conductive clasp 116 has a plurality of protruding ribs 1161 which protrude inwardly from an outer surface of the conductive clasp 116. Each protruding rib 1161 has two ends formed with an inclined surface 1162. An included angle is formed between the inclined surface 1162 and an inner surface of the conductive clasp 116, which is between 10 to 80 degrees. Two side parts of the conductive clasp 116 are curved inward to clasp the wires C. The above structure has advantages that cores of the wires C can be prevented from being damaged by two ends of the protruding rib 1161 when the two side parts are deformed inward.

The socket terminal 11 further includes a pair of embedding tabs 114 arranged between the fixing portion 112 and the conductive clasp 116. The embedding tab 114 benefits the fixing of the socket terminal 11 in the insulated housing 19.

In this embodiment, each contacting arm 111 has an elastic clasp 113, a port portion 115, and a pair of extending portions 117. The elastic clasp 113 extends forward from the fixing portion 112 along the longitudinal direction. The port portion 115 connects a front end of the elastic clasp 113, and is substantially U-shaped or C-shaped, such that an opening is defined. At the front end of the socket terminal 11, the two openings of the port portions 115 are opposite to each other. The extending portion 117 extends rearward from an inner side of the port portion 115. A part of the elastic clasp 113 is curved inward to form a second contacting portion 1132. A part of the port portion 115 and the extending portion 117 are configured to a first contacting section. The number of the extending portion 117 can be at least one, and extends rearward from one end of the port portion 115 along the longitudinal direction.

Figure 3:
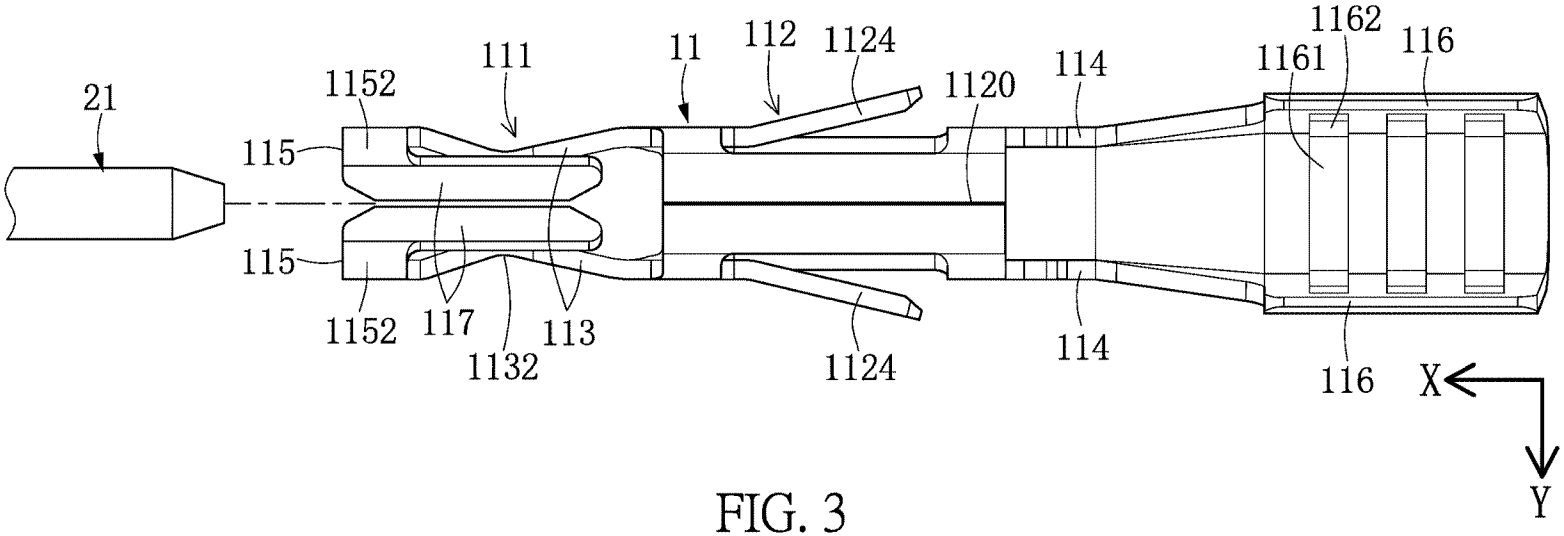
FIG. 3 is a top view of the terminal set of the present disclosure.
Figure 4:
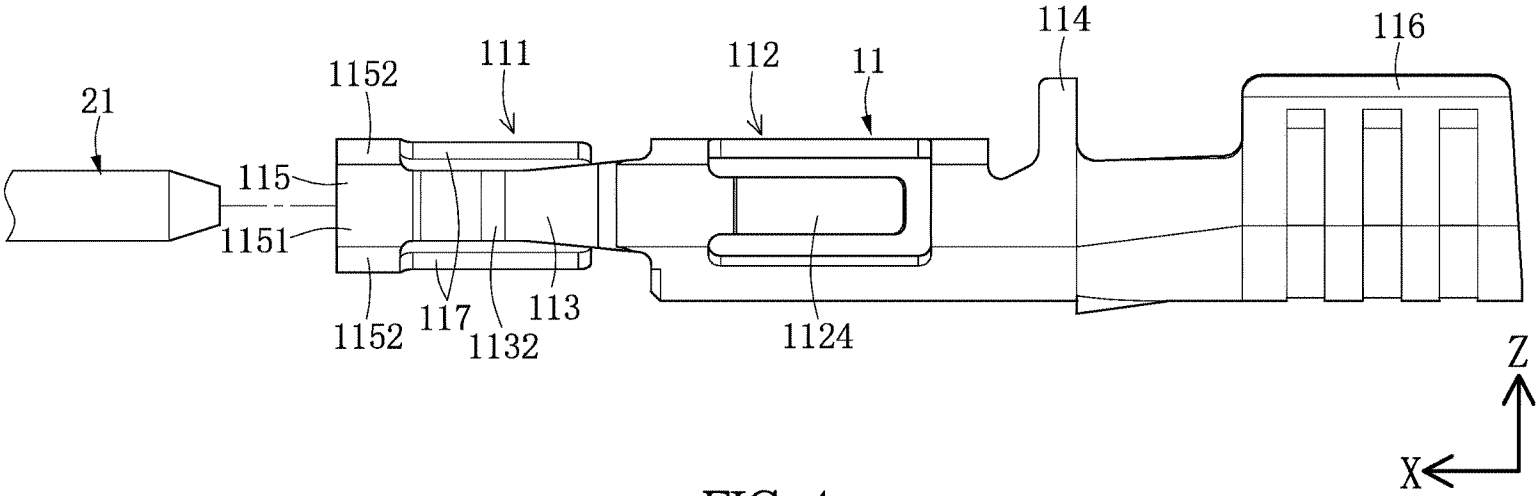
FIG. 4 is a side view of the terminal set of the present disclosure.
Figure 5:
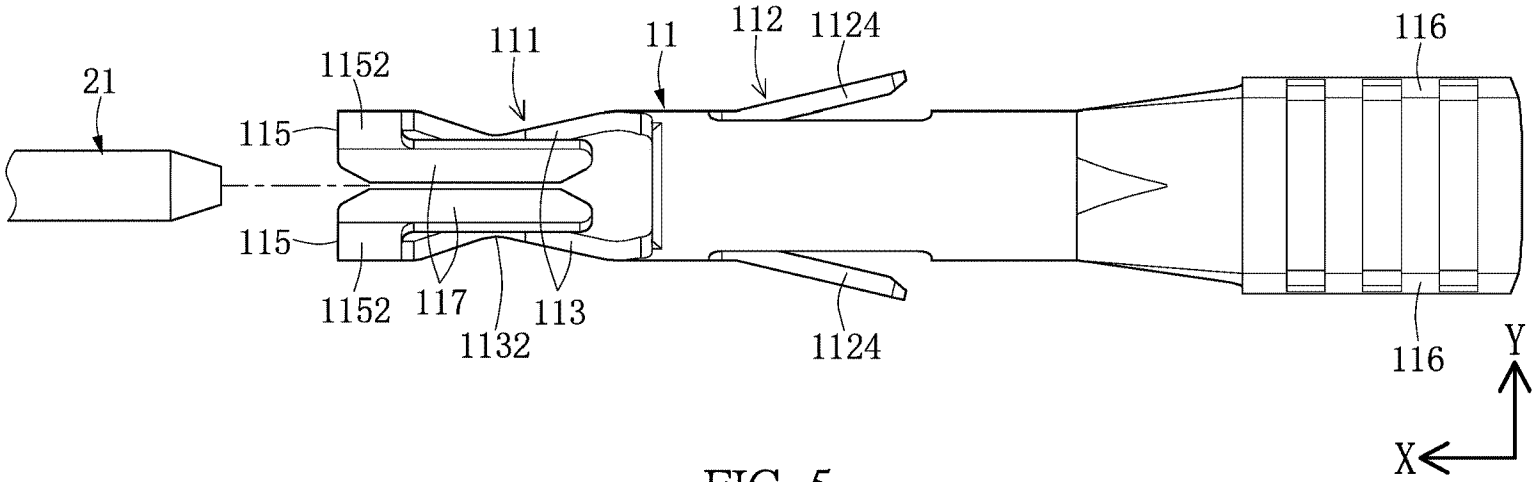
FIG. 5 is a bottom view of the terminal set of the present disclosure.

Reference is made to FIG. 3 to FIG. 5, which are a top view, a side view and a bottom view of the socket terminal of the present disclosure. Firstly, the elastic clasp 113 extends inward and incliningly to form the second contacting portion 1132, and then extends outwardly and incliningly to connect with the port portion 115. From the top view, the elastic clasp 113 has an obtuse angle of about 150 degrees. The extending portion 117 extends beyond the second contacting portion 1132. In other words, an excess length of the extending portion 117 beyond the port portion 115 is larger than a distance from the second contacting portion 1132 to the port portion 115. The objective of this design is that, when the plug terminal 21 is pulling outward to leave the socket terminal 11, the plug terminal 21 still contacts the extending portion 117 after being separated from the second contacting portion 1132. The plug terminal 21 can contact the extending portion 117 in both the front and back positions of the second contacting portion 1132, so as to continuously contact the socket terminal 11.

Figure 7:
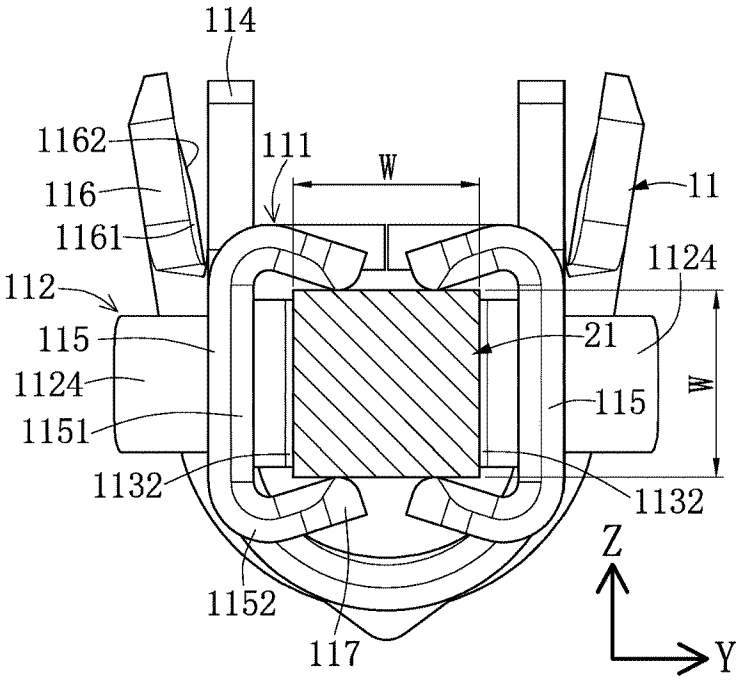
FIG. 7 is a front view of a plug terminal being plugged into the socket terminal of the present disclosure.
Figure 6:
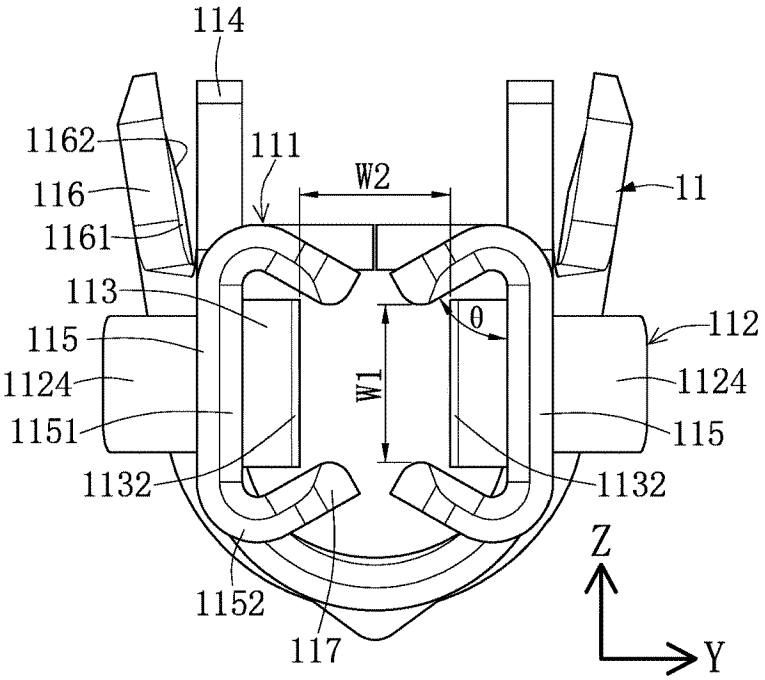
FIG. 6 is a front view of a socket terminal of the present disclosure.

Reference is made to FIG. 6 and FIG. 7. FIG. 6 is a front view of the socket terminal of the present disclosure, and FIG. 7 is a front view of the plug terminal plugged into the socket terminal. In this embodiment, each port portion 115 has an outer wall 1151 and a pair of inward walls 1152. The pair of inward walls 1152 are curved inward from two sides of the outer wall 1151, respectively. The contacting arm 111 has a pair of extending portions 117 connected to the pair of inward walls 1152. As shown in FIG. 7, an included angle θ between the inward wall 1152 and the outer wall 1151 is an obtuse angle, and is about 60 degrees in this embodiment.

A distance W2 between the second contacting portions 1132 of the pair of contacting arms 111 is smaller than a side length W of the plug terminal 21. In other words, when the plug terminal 21 is inserted into the socket terminal 11, the plug terminal 21 can be ensured to contact the second contacting portions 1132. A gap W1 between the pair of inward walls 1152 of the port portion 115 is smaller than the side length W of the plug terminal 21. In other words, a gap between the extending portions 117 is smaller than the side length W of the plug terminal 21. When the plug terminal 21 is inserted in the socket terminal 11, the plug terminal 21 can ensured to contact the pair of the inward walls 1152.

To sum up, the present disclosure at least has characteristics and advantages as follows. During a hot plugging process of the plug connector 20 and the socket connector 10, when the plug terminal 21 is inserting into the socket terminal 11, the plug terminal 21 firstly contacts the inward wall 1152 of the port portion 115. If an electric arc is generated, it only strikes the extending portion 117. During the plugging process, the plug terminal 21 continuously contacts the extending portion 117, and then contacts the pair of second contacting portions 1132 of the contacting arms 111. When the plug terminal 21 is pulling away from the socket terminal 11, especially after the plug terminal 21 leaves the second contacting portion 1132, the plug terminal 2 is still in continuous contact with the extending portion 117, and finally leaves the port portion 115. Even if an electric arc is generated when the plug terminal 2 is pulled out, the electric arc only strikes the extending portion 117. Therefore, the second contacting portion 1132 of the elastic clasp 113 can be prevented from being damaged by the electric arc, and can avoid residual carbon deposit from the electric arc. By the above arrangement, the present disclosure can reduce the problems of damage to the socket terminal 11 by the electric arc, so as to prolong the service life of the socket terminal 11 and the socket connector.

For the purposes of describing and defining the present teachings, it is noted that the term "substantially" is utilized herein to represent the inherent degree of uncertainty that may be attributed to any quantitative comparison, value, measurement or other representation. The term "substantially" is also utilized herein to present the degree by which a quantitative representation may vary from a stated reference without resulting in a change in the basic function of the subject matter at issue.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A socket connector, comprising:

an insulated housing, being formed with at least one terminal passage; and at least one socket terminal, received in the at least one terminal passage, the at least one socket terminal having a fixing portion, a conductive clasp, and a pair of contacting arms; the conductive clasp extending rearward from the fixing portion along a longitudinal direction, the pair of contacting arms extending forward from two opposite sides of the fixing portion, respectively, and facing each other;

wherein each of the contacting arms includes an elastic clasp, a port portion, and at least one extending portion, the elastic clasp extending forward from the fixing portion along the longitudinal direction, the port portion connecting to a front end of the elastic clasp, the at least one extending portion extending rearward from an inner side of the port portion, wherein a part of the elastic clasp is curved inward to form a second contacting portion, and a part of the port portion and the extending portion are configured to form a first contacting section;

wherein the elastic clasp extends inward and inclinedly to form the second contacting portion, and then extends outward and inclinedly to connect with the port portion;

wherein each of the port portions includes an outer wall and a pair of inward walls, the pair of inward walls connecting to the outer wall and being curved inward from two sides of the outer wall, wherein the contacting arm includes a pair of extending portions respectively connected to the pair of inward walls;

wherein the socket connector mates with a plug connector, and the plug connector includes at least one plug terminal, the at least one plug terminal is shaped as a square pin, wherein a distance between the second contacting portions of the pair of contacting arms is smaller than a side length of the plug terminal; wherein a gap between the pair of inward walls of the port portion is smaller than the side length of the plug terminal.

2. The socket connector as claimed in claim 1, wherein the fixing portion is substantially shaped as a hollow cylinder along the longitudinal direction and is formed with a linking seam.

3. The socket connector as claimed in claim 1, wherein the conductive clasp has a plurality of protruding ribs, the protruding ribs protruding inwardly from an outer surface of the conductive clasp, wherein each of the protruding ribs has two ends respectively formed with an inclined surface, and an included angle is formed between the inclined surface and an inner surface of the conductive clasp, the included angle being between 10 and 80 degrees.

4. The socket connector as claimed in claim 1, wherein the socket terminal further includes a pair of embedding tabs arranged between the fixing portion and the conductive clasp.

5. The socket connector as claimed in claim 1, wherein the extending portion extends beyond the second contacting portion, and an excess length of the extending portion beyond the port portion is larger than a distance from the second contacting portion to the port portion.

6. The socket connector as claimed in claim 1, wherein an included angle between the inward wall and the outer wall is an obtuse angle.

7. A socket terminal, comprising:

a fixing portion;

a conductive clasp, extending rearward from the fixing portion along a longitudinal direction; and a pair of contacting arms, extending forward from two opposite sides of the fixing portion, respectively, and facing each other;

wherein each of the contacting arms includes an elastic clasp, a port portion, and at least one extending portion, the elastic clasp extending forward from the fixing portion along the longitudinal direction, the port portion connecting to a front end of the elastic clasp, the at least one extending portion extending rearward from an inner side of the port portion, wherein a part of the elastic clasp is curved inward to form a second contacting portion, and a part of the port portion and the extending portion are configured to form a first contacting section;

wherein the elastic clasp extends inward and inclinedly to form the second contacting portion, and then extends outward and inclinedly to connect with the port portion;

wherein each of the port portions includes an outer wall and a pair of inward walls, the pair of inward walls connecting to the outer wall and being curved inward from two sides of the outer wall, wherein the contacting arm includes a pair of extending portions respectively connected to the pair of inward walls;

wherein the socket terminal mates with a plug terminal, the plug terminal is shaped as a square pin, wherein a distance between the second contacting portions of the pair of contacting arms is smaller than a side length of the plug terminal; wherein a gap between the pair of inward walls of the port portion is smaller than the side length of the plug terminal.

8. The socket terminal as claimed in claim 7, wherein the fixing portion is substantially shaped as a hollow cylinder along the longitudinal direction and is formed with a linking seam.

9. The socket terminal as claimed in claim 7, wherein the conductive clasp has a plurality of protruding ribs, the protruding ribs protrude inwardly from an outer surface of the conductive clasp, each of the protruding ribs has two ends respectively formed with an inclined surface, an included angle is formed between the inclined surface and an inner surface of the conductive clasp, and the included angle is between 10 and 80 degrees.

10. The socket terminal as claimed in claim 7, wherein the socket terminal further includes a pair of embedding tabs arranged between the fixing portion and the conductive clasp.

11. The socket terminal as claimed in claim 7, wherein the extending portion extends beyond the second contacting portion, and an excess length of the extending portion beyond the port portion is larger than a distance from the second contacting portion to the port portion.

12. The socket terminal as claimed in claim 7, wherein an included angle between the inward wall and the outer wall is an obtuse angle.

* * * * *